US012427389B2

(12) United States Patent
Wu

(10) Patent No.: US 12,427,389 B2
(45) Date of Patent: Sep. 30, 2025

(54) MULTI-LEG MOVABLE PUNCHING BAG

(71) Applicant: ZHANGZHOU TAILISI SPORTS EQUIPMENT CO., LTD, Fujian (CN)

(72) Inventor: Jianhong Wu, Zhangzhou (CN)

(73) Assignee: ZHANGZHOU TAILISI SPORTS EQUIPMENT CO., LTD, Fujian (CN)

( * ) Notice: Subject to any disclaimer, the term of this patent is extended or adjusted under 35 U.S.C. 154(b) by 84 days.

(21) Appl. No.: 18/395,324

(22) Filed: Dec. 22, 2023

(65) Prior Publication Data

US 2024/0123312 A1 Apr. 18, 2024

(30) Foreign Application Priority Data

Aug. 3, 2023 (CN) ..... 202322076499.1

(51) Int. Cl.
*A63B 69/20* (2006.01)
*A63B 69/34* (2006.01)

(52) U.S. Cl.
CPC ..... *A63B 69/20* (2013.01); *A63B 69/34* (2013.01)

(58) Field of Classification Search
CPC ..... A63B 69/20; A63B 69/22; A63B 69/34; A63B 69/215; A63B 69/224; A63B 2071/026; A63B 2209/00
See application file for complete search history.

(56) References Cited

U.S. PATENT DOCUMENTS 5,961,426 A * 10/1999 Spector ..... A63B 69/20 446/223
6,106,443 A * 8/2000 Kuo ..... A63B 69/22 482/90
8,052,582 B2 * 11/2011 Summers ..... A63B 21/0004 473/441
9,174,108 B2 * 11/2015 Siklosi ..... A63B 69/22
9,517,398 B2 * 12/2016 Fu ..... A63B 69/20
11,707,661 B1 * 7/2023 Magrino ..... A63B 21/0602 482/86
2005/0090337 A1 * 4/2005 Ross ..... A63B 69/0002 473/451
2015/0051053 A1 * 2/2015 Conen ..... A63B 21/4035 482/108
2020/0030181 A1 * 1/2020 Lin ..... A63B 22/20
2024/0123313 A1 * 4/2024 Wu ..... A63B 69/22

FOREIGN PATENT DOCUMENTS

CN 204767289 U 11/2015

* cited by examiner

*Primary Examiner* — Megan Anderson

(57) ABSTRACT

A multi-leg movable punching bag includes a punching bag body and a base. An interior of the punching bag body is communicated with an interior of the base, and the punching bag body and the base are both hollow. The punching bag body is welded with the base by hot melting. The punching bag body and the base are both made of an elastic material. The base includes a plurality of support legs, and any two adjacent support legs are arranged at a fixed angle. The punching bag body and the base are both made of an elastic material so that the they can be folded and stored when the punching bag is not in use.

12 Claims, 2 Drawing Sheets

MULTI-LEG MOVABLE PUNCHING BAG

CROSS-REFERENCE TO RELATED APPLICATIONS

This application claims the benefit of priority from Chinese Patent Application No. 202322076499.1, filed on Aug. 3, 2023. The content of the aforementioned application, including any intervening amendments thereto, is incorporated herein by reference in its entirety.

TECHNICAL FIELD

This application relates to punching bags for boxing training, and more particularly to a multi-leg movable punching bag.

BACKGROUND

A traditional standing punching bag for boxing training includes a punching bag body and a base, which are connected through an elastic support rod, such that the punching bag body can swing with the elastic support rod during the punching process. However, because the base is integrated and does not produce displacement, the training lacks an advance and retreat interaction between two sides in an actual combat. The practitioner only punches around the punching bag body, which lacks confrontation, resulting in a poor actual combat experience. In view of the problems, a movable punching bag (Chinese Patent No. 204767289 U) has been designed, including a punching bag body and three counterweight support legs. The counterweight is reasonably set such that the punching bag can move when it is hit in a boxing training, which can improve the actual combat experience. The three support legs are fixedly connected through a fixing block to increase the center-of-gravity stability of the movable punching bag. With the popularization of online shopping, the movable punching bag with such fixed structure faces a great challenge due to the high transportation cost caused by large size and weight. Moreover, the non-detachable structure makes the storage inconvenient.

In view of the above problems, a novel multi-leg movable punching bag is provided herein.

SUMMARY

The present disclosure provides a multi-leg movable punching bag, which can be stored in a folded state, and has a strong support stability, to solve the problems of large size and weight and high transportation cost in the existing movable punching bags.

The present disclosure provides a multi-leg movable punching bag, comprising:

a punching bag body; and a base;

wherein an interior of the punching bag body is communicated with an interior of the base, and the punching bag body and the base are both hollow; the punching bag body is weldedly connected with the base by hot melting; the punching bag body is made of a first elastic material, and the base is made of a second elastic material; and the base comprises a plurality of support legs, and any two adjacent support legs of the plurality of support legs are arranged at a fixed angle.

In an embodiment, an interior of each of the plurality of support legs includes an inflation cavity and a water injection cavity from top to bottom. The inflation cavity and the water injection cavity are separated through an elastic isolation layer, and the elastic isolation layer is welded with an inner wall of each of the plurality of support legs by hot melting. And the inflation cavity is communicated with the punching bag body.

In an embodiment, the elastic isolation layer is located one-third of a way up from a bottom of each of the plurality of support legs.

In an embodiment, the elastic isolation layer is made of Hypalon.

In an embodiment, the first elastic material and the second material are both Hypalon.

In an embodiment, a top of the punching bag body is provided with an air injection part, and a water injection part is provided on a side wall of the water injection cavity.

In an embodiment, an outer surface of a connection between the punching bag body and each of the plurality of support legs is provided with a reinforcement ring.

In an embodiment, the number of the plurality of support legs is three.

In an embodiment, an elastic foamed layer is arranged on an outer surface of the punching bag body.

In an embodiment, a thickness of the elastic foamed layer is 2-3 cm.

The present disclosure has the following beneficial effects.

Regarding the multi-leg movable punching bag provided herein, the punching bag body and the base are both made of an elastic material, such that they can be folded and stored, thereby greatly reducing the transportation cost and the space occupation. Owing to the arrangement of the elastic isolation layer, when the punching bag body is filled with air, the air will continue to apply pressure to the elastic isolation layer, so that the elastic isolation layer is deformed towards the water injection cavity to gradually compress water in the water injection cavity, and at this time, a hardness of the water injection cavity is greatly increased so as to greatly improve the support stability of the plurality of support legs.

BRIEF DESCRIPTION OF THE DRAWINGS

The present disclosure will be further described below with reference to the accompanying drawings and embodiments.

Figure 1:
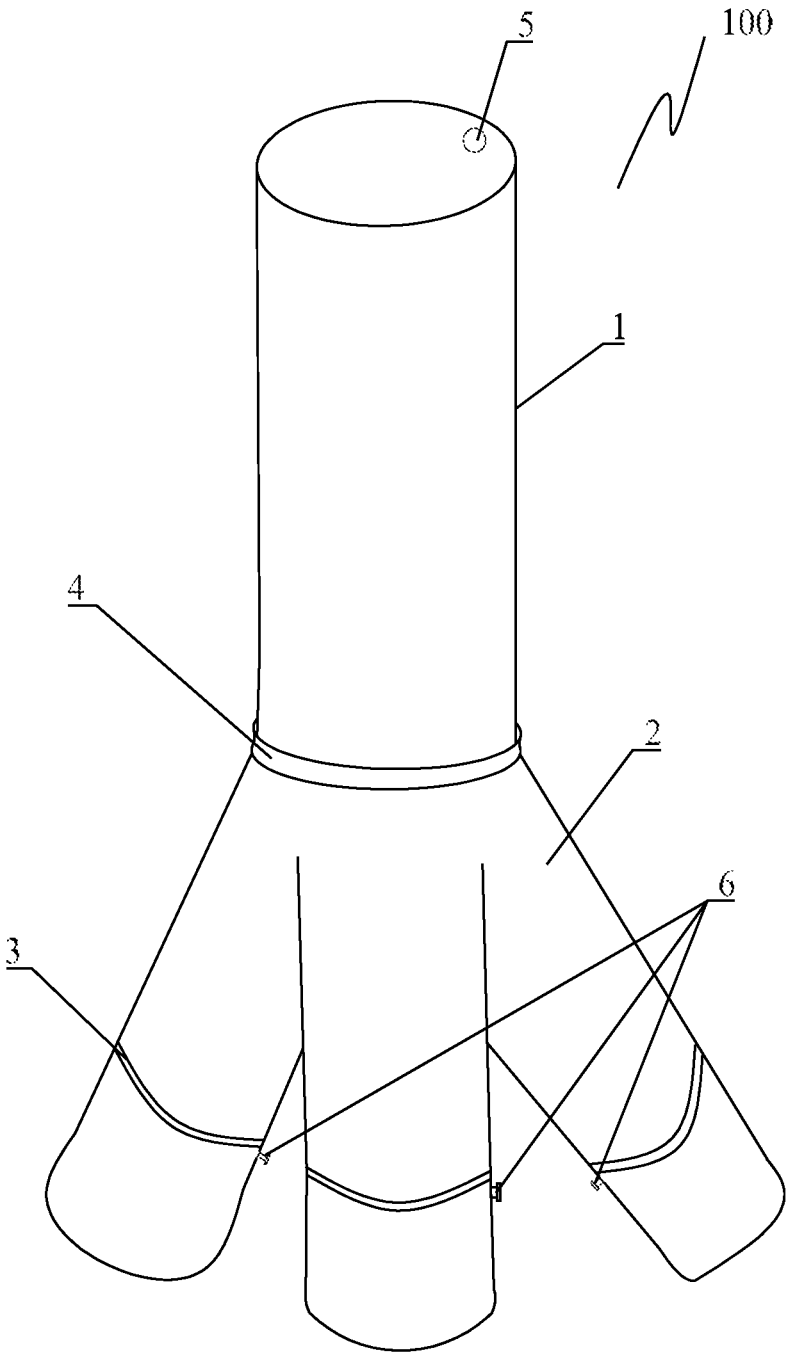
FIG. 1 is a schematic diagram of a structure of a multi-leg movable punching bag according to an embodiment of the present disclosure.

In the figures: multi-leg movable punching bag 100, punching bag body 1, base 2, support leg 21, inflation cavity 22, water injection cavity 23, elastic isolation layer 3, reinforcement ring 4, air injection part 5, and water injection part 6.

DETAILED DESCRIPTION OF EMBODIMENTS

In order to make purposes, technical schemes and beneficial effects of the present disclosure clearer, the present disclosure will be clearly and completely described below with reference to the accompanying drawings and embodiments. Obviously, described herein are only several embodiments of the disclosure, instead of all embodiments. Therefore, the embodiments described herein are only to illustrate this application rather than limiting this application. It should be noted that any other embodiments made by those skilled in the art without departing from the spirit of this application shall fall within the scope of this application defined by the appended claims.

Figure 2:
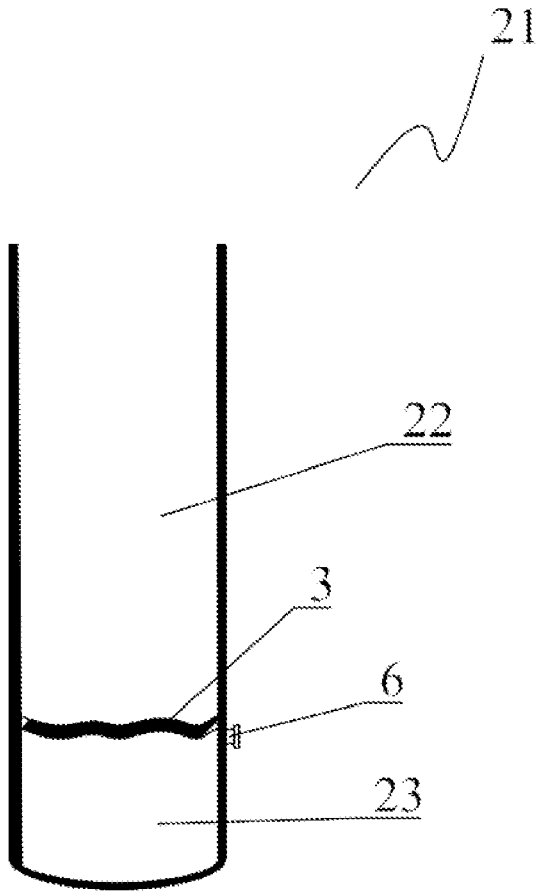
FIG. 2 is a sectional view of a support leg according to an embodiment of the present disclosure.

Referring to FIGS. 1-2, the present disclosure provides a multi-leg movable punching bag 100, including a punching bag body 1 and a base 2. An interior of the punching bag body is communicated with an interior of the base 2, and the punching bag body 1 and the base 2 are both hollow. The base 2 includes a plurality of support legs 21, and any two adjacent support legs 21 of the plurality of support legs 21 are arranged at a fixed angle. The punching bag body 1 is made of a first elastic material, and the base 2 is made of a second elastic material, so that the punching bag body 1 and the base 2 can be folded and stored, thereby greatly reducing the transportation cost and the space occupation.

In an embodiment, the punching bag body 1 is weldedly connected with the base 2 by hot melting, so as to ensure a sealing of the multi-leg movable punching bag 100, and air in the multi-leg movable punching bag 100 will not leak.

In an embodiment, an interior of each of the plurality of support legs includes an inflation cavity 22 and a water injection cavity 23 from top to bottom. The inflation cavity 22 and the water injection cavity 23 are separated by an elastic isolation layer 3, and the elastic isolation layer 3 is welded with an inner wall of each of the plurality of support legs 21 by hot melting. And the inflation cavity 22 is communicated with the punching bag body 1. During the installation, the water injection cavity 23 is filled with water to make the plurality of support legs stand to play a support role. Then the punching bag body 1 is filled with air, and the multi-leg movable punching bag 100 is integrally formed because the inflation cavity 22 is communicated with the punching bag body 1. Because of an arrangement of the elastic isolation layer 3, after the punching bag body is filled with the air, the air will continue to put pressure on the elastic isolation layer 3, so that the elastic isolation layer is deformed towards the water injection cavity 23. And the elastic isolation layer 3 gradually compresses water in the water injection cavity 23, at this time, a hardness of the water injection cavity 23 is greatly increased, so as to greatly improve a support stability of the plurality of support legs 21.

In an embodiment, the elastic isolation layer 3 is located one-third of a way up from a bottom of each of the plurality of support legs, so as to ensure a support stability of the plurality of support legs 21, and the plurality of support legs 21 will not be too heavy to move flexibly during being hit.

In an embodiment, the elastic isolation layer 3 is made of Hypalon. The Hypalon is combined by polychloroprene and chlorosulfonated polyethylene (CSM), which is usually used in the production of rubber dinghies, so that the elastic isolation layer 3 has characteristics of good waterproof performance and good wear resistance. The elastic isolation layer 3 can also be made of polyvinyl chloride (PVC) fabric or polyurethane fabric.

In an embodiment, in order to be convenient to fold and store the multi-leg movable punching bag 100, the elastic punching bag body 1 is made of Hypalon and the elastic base 2 is made of Hypalon. The elastic punching bag body 1 can also be made of PVC fabric, and the elastic base 2 can also be made of PVC fabric. And the elastic punching bag body 1 can be also made of polyurethane fabric, and the elastic base 2 can also be made of polyurethane fabric.

In an embodiment, a top of the punching bag body 1 is provided with an air injection part 5. The air injection part 5 is arranged on the top of the punching bag body to avoid impact on hitting of the users. A water injection part 6 is arranged on a side wall the water injection cavity 23. The water injection part 6 is arranged in an interior of the side wall of each of the plurality of support legs 21, so as to avoid impact on hitting of the users. A structure of the air injection part 5 is composed of a conventional air injection hole and a first sealing cover, and a structure of the water injection part 6 is composed of a water inlet and a second sealing cover, which will not describe in detail herein.

In an embodiment, an outer surface of the connection between the punching bag body 1 and each of the plurality of support legs 21 is provided with a reinforcement ring 4, which can enhance the connection strength, so as to ensure that the punching bag body 1 is always kept in a vertical state and is not easy to be tilted when stricken.

In an embodiment, the base 2 includes three support legs 21. An angle between any two adjacent support legs 21 is the same to ensure the support stability of the three support legs 21.

In an embodiment, an outer surface of the punching bag body 1 is provided with an elastic foamed layer (not shown in the figures) to improve the hitting experience. And a thickness of the elastic foamed layer is 2-3 cm.

Described above are specific embodiments of the present disclosure, which are merely illustrative, and are not intended to limit this application in any form. Though the present disclosure has been described in detail above, various variations, improvements and modifications can still be made by those skilled in the art. It should be noted that those variations, improvements and modifications made without departing from the spirit of this application shall fall within the scope of this application defined by the appended claims.

What is claimed is:

1. A multi-leg movable punching bag, comprising:

a punching bag body; and a base;

wherein an interior of the punching bag body is communicated with an interior of the base, and the punching bag body and the base are hollow; the punching bag body is weldedly connected with the base by hot melting; the punching bag body is made of a first elastic material and the base is made of a second elastic material; and the base comprises a plurality of support legs, and any two adjacent support legs of the plurality of support legs are arranged at a fixed angle;

an interior of each of the plurality of support legs comprises an inflation cavity and a water injection cavity from top to bottom, and the inflation cavity and the water injection cavity are separated through an elastic isolation layer; the elastic isolation layer is welded with an inner wall of each of the plurality of support legs by hot melting; and the inflation cavity is communicated with the punching bag body; and an outer surface of a connection between the punching bag body and each of the plurality of support legs is provided with a reinforcement ring.

2. The multi-leg movable punching bag of claim 1, wherein an elastic foamed layer is arranged on an outer surface of the punching bag body.

3. The multi-leg movable punching bag of claim 2, wherein a thickness of the elastic foamed layer is 2-3 cm.

4. The multi-leg movable punching bag of claim 1, wherein the elastic isolation layer is located one-third of a way up from a bottom of each of the plurality of support legs.

5. The multi-leg movable punching bag of claim 1, wherein a top of the punching bag body is provided with an air injection part; and a water injection part is provided on a side wall of the water injection cavity.

6. A multi-leg movable punching bag, comprising:

a punching bag body; and a base;

wherein an interior of the punching bag body is communicated with an interior of the base, and the punching bag body and the base are hollow; the punching bag body is weldedly connected with the base by hot melting; the punching bag body is made of a first elastic material and the base is made of a second elastic material; and the base comprises a plurality of support legs, and any two adjacent support legs of the plurality of support legs are arranged at a fixed angle; and the plurality of support legs comprises three support legs.

7. The multi-leg movable punching bag of claim 6, an interior of each of the plurality of support legs comprises an inflation cavity and a water injection cavity from top to bottom, and the inflation cavity and the water injection cavity are separated through an elastic isolation layer; the elastic isolation layer is welded with an inner wall of each of the plurality of support legs by hot melting; and the inflation cavity is communicated with the punching bag body.

8. The multi-leg movable punching bag of claim 7, wherein the elastic isolation layer is located one-third of a way up from a bottom of each of the plurality of support legs.

9. The multi-leg movable punching bag of claim 7, wherein a top of the punching bag body is provided with an air injection part; and a water injection part is provided on a side wall of the water injection cavity.

10. The multi-leg movable punching bag of claim 7, wherein an outer surface of a connection between the punching bag body and each of the plurality of support legs is provided with a reinforcement ring.

11. The multi-leg movable punching bag of claim 6, wherein an elastic foamed layer is arranged on an outer surface of the punching bag body.

12. The multi-leg movable punching bag of claim 11, wherein a thickness of the elastic foamed layer is 2-3 cm.

* * * * *